US005669506A

United States Patent [19]

Lofgren et al.

[11] Patent Number: 5,669,506

[45] Date of Patent: Sep. 23, 1997

[54] SUSPENSION PACKAGE

[75] Inventors: Lewis C. Lofgren; Noel M. Phillips, both of Chicago, Ill.

[73] Assignee: Ade, Inc., Chicago, Ill.

[21] Appl. No.: 690,486

[22] Filed: Jul. 31, 1996

[51] Int. Cl.[6] ..... B65D 81/07

[52] U.S. Cl. ..... 206/583; 206/594

[58] Field of Search ..... 206/485, 521, 206/583, 591, 594

[56] References Cited

U.S. PATENT DOCUMENTS

| | | | |
|---|---|---|---|
| 2,837,208 | 3/1958 | Lingenfelter . | |
| 3,752,301 | 8/1973 | Bluemel | 206/583 |
| 3,853,220 | 12/1974 | Luray | 206/583 |
| 4,606,459 | 8/1986 | Luray . | |
| 4,852,743 | 8/1989 | Ridgeway . | |
| 5,056,665 | 10/1991 | Boecker et al. . | |
| 5,211,290 | 5/1993 | Janus et al. . | |
| 5,226,542 | 7/1993 | Boecker et al. . | |
| 5,322,168 | 6/1994 | Kataoka . | |
| 5,323,896 | 6/1994 | Jones . | |
| 5,394,985 | 3/1995 | Van Hest . | |
| 5,501,339 | 3/1996 | Suzuki et al. . | |
| 5,579,917 | 12/1996 | Lofgren et al. | 206/583 |

FOREIGN PATENT DOCUMENTS

| | | | |
|---|---|---|---|
| 1258957 | 3/1961 | France | 206/485 |

*Primary Examiner*—Jimmy G. Foster
*Attorney, Agent, or Firm*—Brinks Hofer Gilson & Lione

[57] ABSTRACT

A suspension package includes a base and first and second end panels. A hammock is stretched between the end panels, each of which is held in an operational position by a triangulating brace which extends from each end panel to the base and is removably secured to the base. Side panels are connected to the base to fold between a coplanar position and an operational position. When the side panels are in the coplanar position, the side panels and the base can be folded along a center fold to reduce tension on the hammock. Once a product is placed in the hammock, the side panels are moved to the operational position, perpendicular to the base. In the operational position the side panels prevent the base from folding along the center fold and thereby tension the hammock. The entire suspension package can be formed from a single piece of a suitable material such as corrugated paperboard.

18 Claims, 3 Drawing Sheets

SUSPENSION PACKAGE

BACKGROUND OF THE INVENTION

This invention relates to an improved suspension package of the type that uses a hammock stretched between two opposed end panels to suspend the product being packaged away from the walls of the package.

Suspension packages of the general type described above are known to the art, as shown for example in Luray U.S. Pat. No. 4,606,459 and Becker U.S. Pat. No. 5,226,542. The packages shown in the Luray and Becker patents include an inner frame across which a hammock is stretched, and an outer container that encloses the inner frame and the product being packaged. Packages of this type have been found to be an effective way of packaging fragile products for shipment and storage.

Nevertheless, a need exists for an improved suspension package that is particularly adapted for low-cost applications.

SUMMARY OF THE INVENTION

According to a first aspect of this invention, a suspension package is provided comprising a base and first and second end panels, wherein each end panel is secured to a respective end of the base. A product-supporting hammock is connected between the end panels, and a brace extends between the first end panel and the base. This brace secures the first end panel in an operational position in which the hammock is held away from the base by the first end panel, and the brace is interposed between the hammock and the base. Preferably, the brace extends diagonally between the base and the end panel to hold the end panel in the operational position, and most preferably the brace is removably held in place such that the end panel can be collapsed prior to use.

According to a second aspect of this invention, a suspension package is provided comprising a base, first and second end panels secured to respective ends of the base to extend outwardly therefrom, and a product-supporting hammock connected between the end panels. First and second side panels are provided, each secured to a respective side of the base, and a first fold line extends across the base and the side panels. This first fold line is oriented such that folding the base and the side panels at the first fold line to move the end panels toward one another reduces tension on the hammock. Preferably, the side panels are secured to the base at respective second fold lines, and the side panels restrain the base against folding at the first fold line, thereby tensioning the hammock, when the side panels are folded to an operational position in which the side panels are positioned alongside the hammock.

DETAILED DESCRIPTION OF THE PRESENTLY PREFERRED EMBODIMENTS

Figure 1:
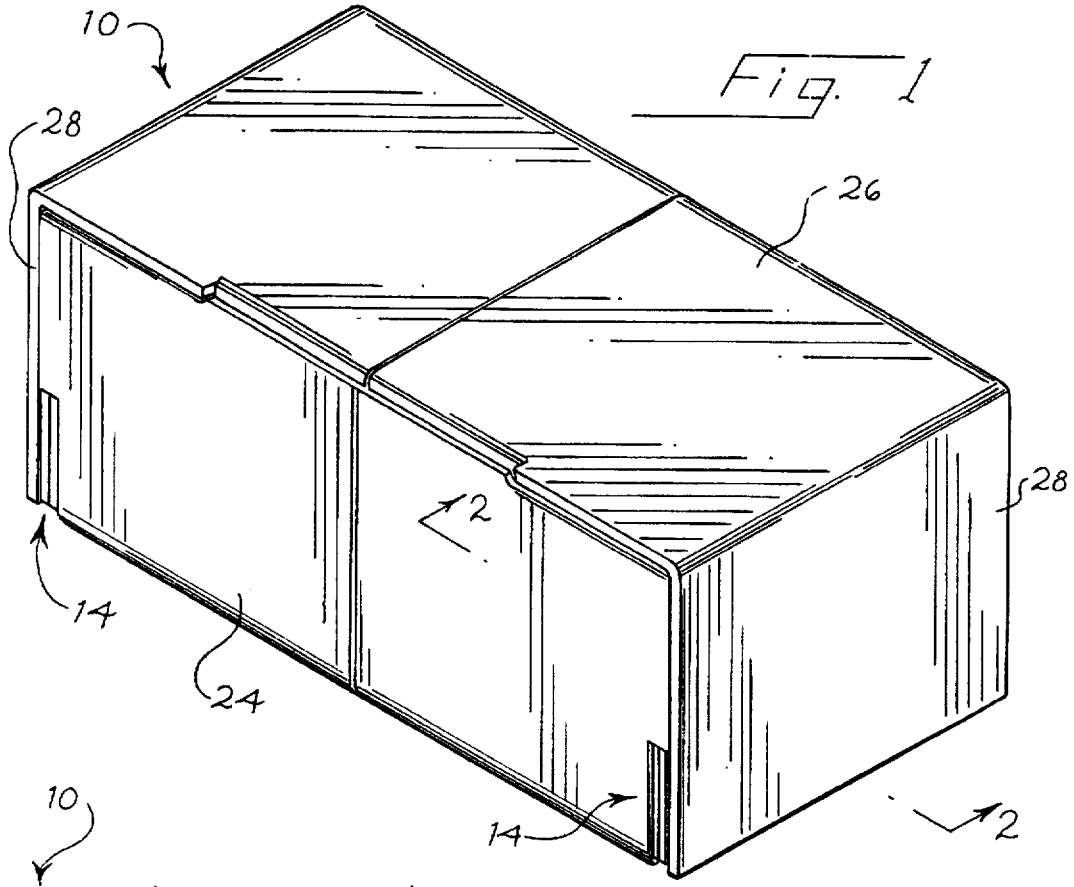
FIG. 1 is a perspective view of a suspension package which incorporates a presently preferred embodiment of this invention.
Figure 2:
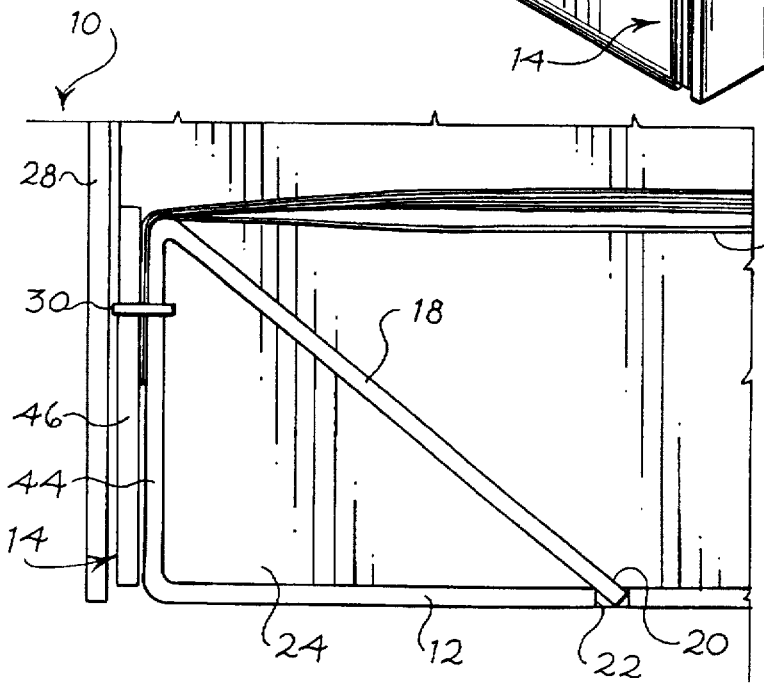
FIG. 2 is a partial cross-sectional view taken along line 2—2 of FIG. 1.

Turning now to FIGS. 1 and 2, these drawings show two views of a suspension package 10 which incorporates a presently preferred embodiment of this invention. The suspension package 10 includes a base 12 which supports two end panels 14, one at either end of the base 12. In the operational position shown in FIG. 2, the end panel 14 is held substantially perpendicular to the base 12 by a brace 18. The brace 18 is connected to the end panel 14 by a fold line near the top of the brace 18, and is removably attached to the base 12 by a tab 20 that fits within a slot 22 formed in the base 12.

FIG. 2 shows only one of the two end panels 14 and braces 18; the other, nonillustrated end of the suspension package is the mirror image of the illustrated end. As shown in FIG. 2, each end panel 14 supports one end of a product-supporting hammock 16. Each end of the hammock 16 can be secured in place in the respective end panel 14 by a staple 30, as shown in FIG. 2. In this example, the hammock 16 is formed of a film of a stretchable, tough material such as polyurethane. The hammock 16 preferably includes a central portion facing the base 12, and two side portions. The first side portion overlies the central portion, and the second side portion overlies the first side portion. This arrangement, called a "C-fold" in the art, allows the product to be inserted into the hammock 16 from the top, and then retained in place in the hammock by tension on the hammock.

As shown in FIGS. 1 and 2, the suspension package 10 includes side panels 24 that extend perpendicular to the base 12 and the end panels 14 in the fully assembled configuration. In this configuration the side panels 24 are positioned on either side of the hammock 16. At least one of the side panels 24 preferably supports a top panel 26. In the fully closed position the top panel 26 is oriented above the hammock 16, parallel to the base 12, extending between the side panels 24. End flaps 28 can be mounted to the top panel 26 to extend alongside the end panels 14.

Figure 3:
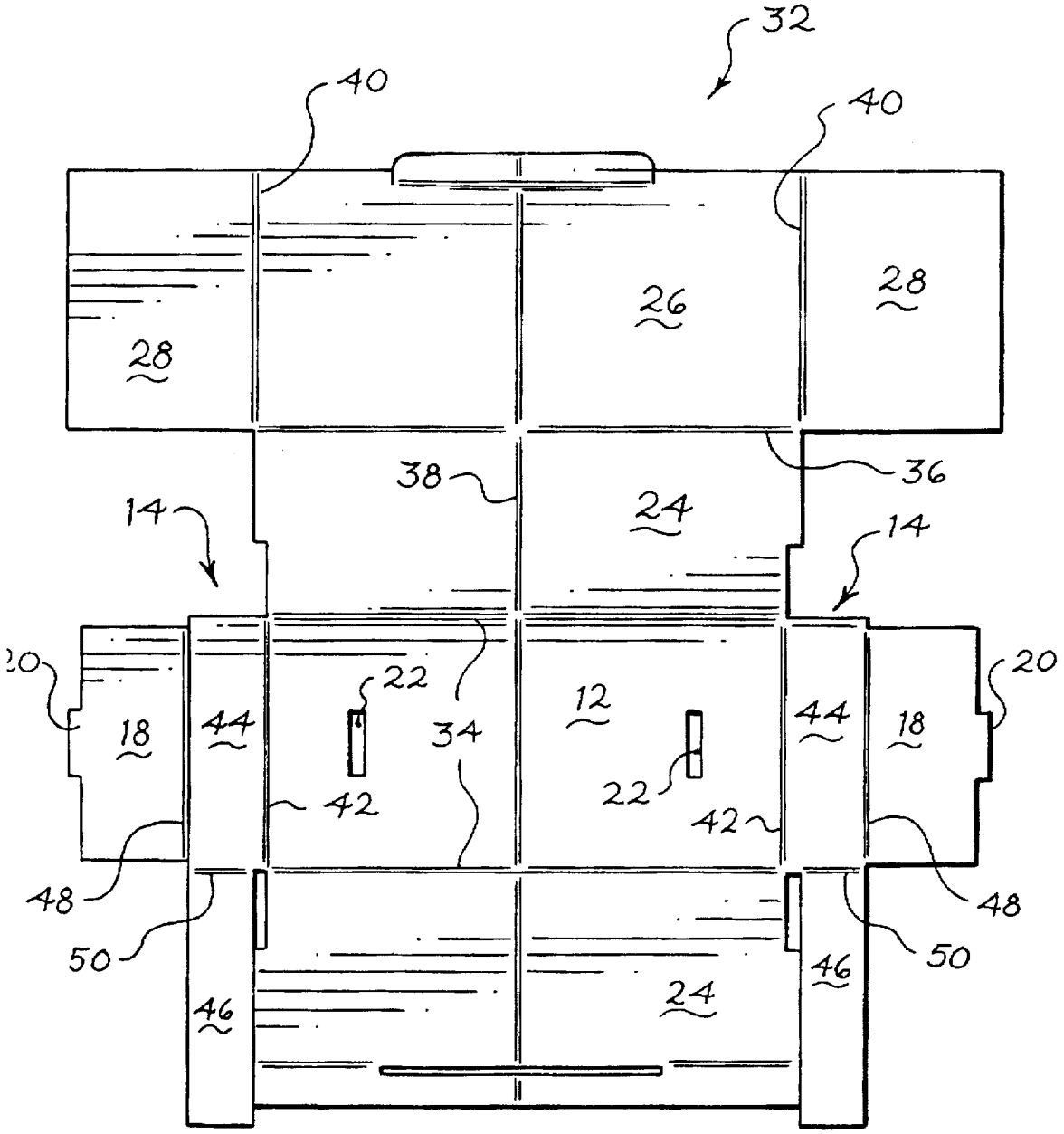
FIG. 3 is a plan view of a paperboard blank from which the suspension package of FIGS. 1 and 2 is folded.

Turning now to FIG. 3, the suspension package 10 of FIGS. 1 and 2 can be formed from a blank 32 that may, for example, be formed of corrugated paperboard. In FIG. 3, the base 12 is connected to the side panels 24 by side folds 34 extending along the sides of the base 12. The top panel 26 is connected to one of the side panels 24 by a top fold 36, and the end flaps 28 are connected to the top panel 26 by flap folds 40. The blank 32 is scored to form a center fold 38 that extends across central portions of the base 12, the side panels 24, and the top panel 26.

The end panels 14 are connected to the ends of the base 12 at respective end folds 42. As shown in FIG. 3, each brace 18 is integrally formed with an inner end panel flap 44 and is connected thereto at a brace fold 48. Each end panel 14 also includes an outer end panel flap 46 which is connected to the inner end panel flap 44 at a respective fold line 50.

The suspension package 10 is assembled by folding the inner end panel flaps 44 upwardly at the end folds 42, and then folding the outer end panel flaps 46 outwardly at the fold lines 50. Then an end of the hammock 16 is placed between the inner and outer end panel flaps 44, 46, and the hammock end 16 is firmly secured in place between the inner and outer end panel flaps 44, 46 by a staple 30 (FIG. 2). The hammock 16 is typically secured to the end panels 14 by the suspension package maker. At this point, the suspension package 10 is essentially complete, from a fabrication point of view. The suspension package 10 can then be folded along the center fold 38, the end folds 42, and the flap folds 40 to produce a flat, compact, collapsed suspension package.

Figure 4:
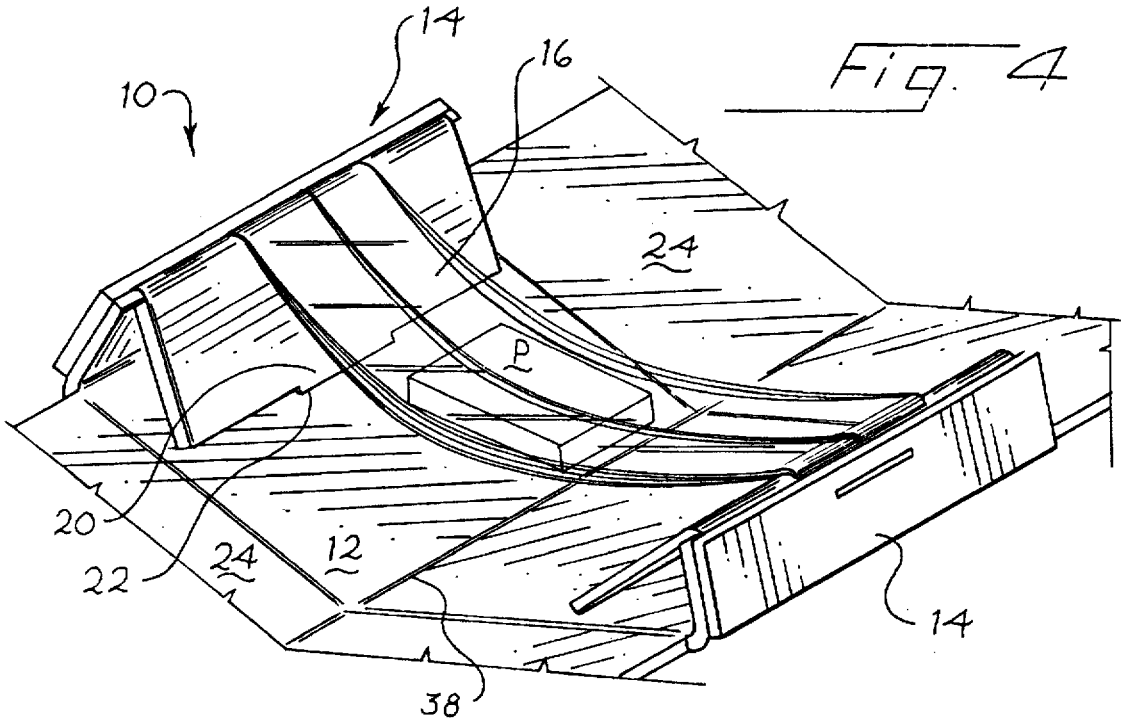
FIG. 4 is a perspective view showing the suspension package of FIGS. 1 and 2 at a first intermediate state of assembly.

When it is desired to load a product into the suspension package 10, the suspension package 10 is first partially assembled by placing the tabs 20 in the slots 22 to secure the end panels 14 in their operational position, as shown in FIG. 4. At this stage of assembly, the base 12, side panels 24, and top panel (not shown in FIG. 4) are still folded at the center fold 38, such that the end panels 14 are angled toward one another, and the hammock 16 is untensioned. At this point, it is convenient to place the product P being packaged into a central portion of the hammock 16. Since the hammock 16 is not under tension, the product P can easily be installed in the hammock 16.

Figure 5:
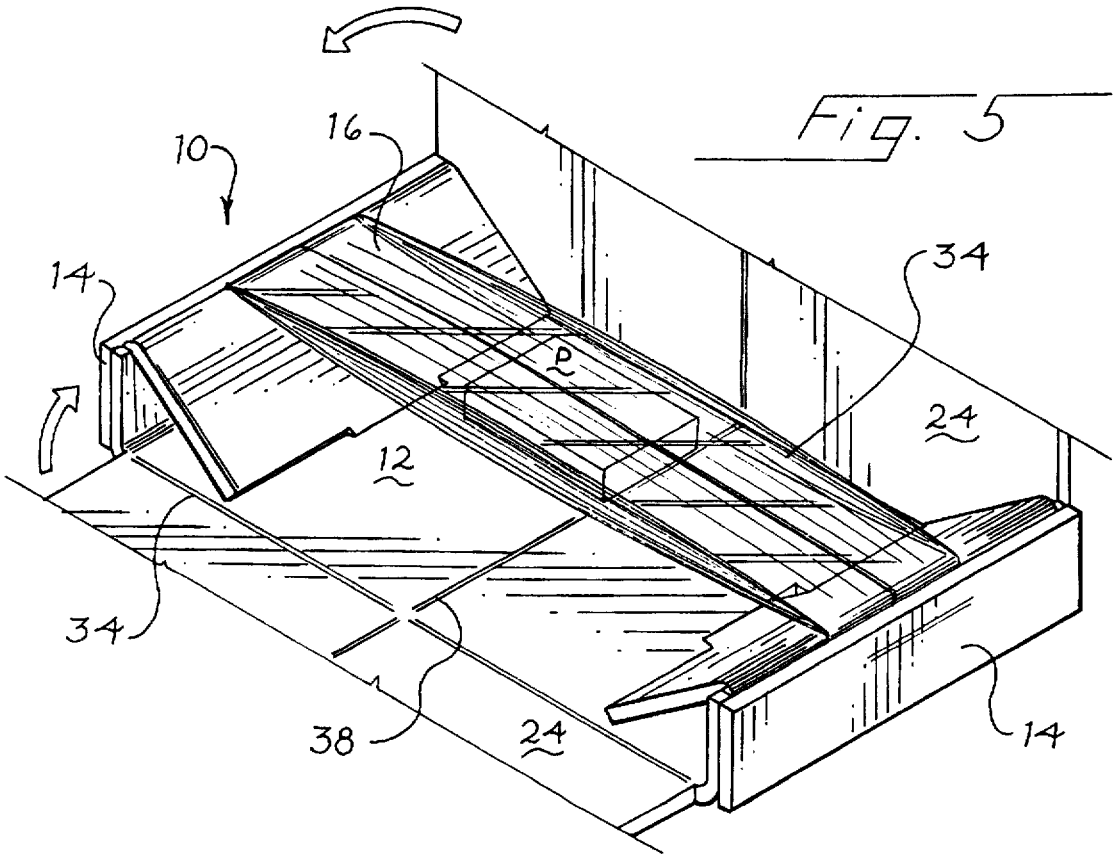
FIG. 5 is a perspective view corresponding to that of FIG. 4 showing the suspension package of FIGS. 1 and 2 at a subsequent stage of assembly.

Once the product P has been installed in the hammock 16, the side panels 24 are then folded upwardly alongside the hammock 16, along the side folds 34. FIG. 5 shows the suspension package 10 in a subsequent stage of assembly, where one of the side panels 24 has been folded along the respective side fold 34 to the operational position, perpendicular to the base 12. It should be noted that when the side panels 24 are folded to the operational position, the side panels 24 automatically straighten the base 12 such that the two parts of the base 12 on either side of the center fold 38 are coplanar. By straightening the base 12, the end panels 14 are moved away from one another, and the hammock 16 is automatically tensioned. The properly tensioned hammock suspends the product P away from the side panels 24, the base 12, and the top panel. The final stage of assembly is to fold the other side panel 24 upwardly and to complete the positioning of the top panel 26 and the end flaps 28 to the fully assembled position of FIG. 1. The top panel 26 and end flaps 28 can then be secured in place, as for example by taping.

The suspension package 10 provides a number of important advantages. First, the entire package 10 can be formed from a single piece of paperboard, and therefore does not require a separate frame and outer box. This reduces material costs and results in a particularly low-cost product. Second, as shown above, the suspension package 10 is collapsible. This reduces transportation and storage costs for the suspension package prior to use. Third, the suspension package 10 is relatively easy to use. The hammock can readily be reached to load the product, and the product can be loaded into the hammock quickly and easily. Fourth, the structure described above automatically tensions the hammock in a simple, straightforward manner that minimizes steps required by the user.

Simply by way of example, the following details of construction have been found suitable. These details of constructions are of course intended only by way of illustration, and are not intended to limit the claimed invention in any way. The suspension package 10 can be formed of corrugated paperboard such as 200 or 275 pound corrugated material (either B or C flute) with the flutes running parallel to the side folds 34 and transverse to the center fold 38. The hammock may be formed of a polyurethane film such as the polyester polyuretahne material supplied by JPS as resin 1495SL, having a thickness in the range of 2–6 mils, depending on the application.

Of course, many changes and modifications can be made to the preferred embodiment described above. For example, if desired the tabs can be formed in the base and can be arranged to engage the ends of the braces. The braces can be secured to the base and removably attached to the end panels. The center fold arrangement can be used without a collapsible end panel and without a diagonal brace, and the diagonal brace can be used without the center fold if desired. Materials for the package can vary widely, and can include materials other than corrugated paperboard. If desired, the suspension package can be made from a suitable plastic or other material. The top panel 26 can be provided with a side flap positioned to lie alongside one of the side panels. If desired, each of the side panels can be provided with a respective top panel, which may overlap if desired. In some applications it may be preferred to delete all top panels and to use the suspension package 10 in combination with an outer box.

It is therefore intended that the foregoing detailed description be regarded as an illustration of one form that the invention may take, and not as a limitation of the invention. It is only the following claims, including all equivalents, which are intended to define the scope of the invention.

We claim:

1. A suspension package comprising:

a base comprising first and second ends;

first and second end panels, each end panel secured to a respective end of the base;

a product-supporting hammock connected to the end panels; and a brace extending between the first end panel and the base, said brace securing the first end panel in an operational position in which the hammock is held away from the base by the first end panel, said brace interposed between the hammock and the base.

2. The invention of claim 1 wherein the base and the first end panel form a corner when the first end panel is in the operational position, and wherein the brace extends diagonally across the corner.

3. The invention of claim 1 wherein the first end panel is movable between the operational position, in which the first end panel extends out of a plane aligned with the base, and a storage position, in which the first end panel collapses adjacent the base; and wherein the brace is removably mounted to at least one of the brace and the first end panel.

4. The invention of claim 1 wherein the brace is secured to the first end panel, and wherein the brace is removably secured to the base by a tab formed in one of the brace and the base.

5. The invention of claim 1 wherein the base further comprises first and second sides extending between the ends, and wherein the suspension package further comprises first and second side panels, each side panel secured to a respective side of the base.

6. The invention of claim 1 further comprising a first fold line extending across the base and the side panels between the braces, said first fold line oriented such that folding the base and the side panels at the first fold line to move the end panels toward one another reduces tension on the hammock.

7. The invention of claim 6 wherein the side panels are secured to the base at respective second fold lines, and wherein the side panels restrain the base against folding at the first fold line, thereby tensioning the hammock, when the side panels are folded to an operational position in which the side panels are positioned alongside the hammock.

8. The invention of claim 7 further comprising a top panel secured to the first side panel and movable to an operational position in which the top panel overlies the hammock.

9. The invention of claim 8 wherein the first fold line additionally extends across the top panel.

10. A suspension package comprising:

a base comprising first and second ends and first and second sides;

first and second end panels, each end panel secured to a respective end of the base to extend outwardly therefrom;

a product-supporting hammock connected to the end panels;

first and second side panels, each side panel secured to a respective side of the base;

a first fold line extending across the base and the side panels, said first fold line oriented such that folding the base and the side panels at the first fold line to move the end panels toward one another reduces tension on the hammock.

11. The invention of claim 10 wherein the side panels are secured to the base at respective second fold lines, and wherein the side panels restrain the base against folding at the first fold line, thereby tensioning the hammock, when the side panels are folded to an operational position in which the side panels are positioned alongside the hammock.

12. The invention of claim 10 further comprising a top panel secured to the first side panel and movable to an operational position in which the top panel overlies the hammock.

13. The invention of claim 12 wherein the first fold line additionally extends across the top panel.

14. The invention of claim 10 wherein each end panel folds between an operational position, in which the hammock is held away from the base by the end panel, and a storage position.

15. The invention of claim 14 further comprising first and second braces, each brace extending diagonally between the base and the respective end panel to hold the end panel in the operational position.

16. The invention of claim 15 wherein each brace is secured to the respective end panel, and wherein each brace is removably secured to the base by a respective tab formed on one of the brace and the base.

17. A suspension package comprising:

a base comprising first and second ends and first and second sides;

first and second end panels, each end panel secured to a respective end of the base to extend outwardly therefrom;

a product-supporting hammock connected to the end panels;

first and second side panels, each side panel secured to a respective side of the base;

a top panel secured to the first side panel and movable to an operational position in which the top panel overlies the hammock;

first and second braces, each brace extending diagonally between the base and the respective end panel to hold the end panel in an operational position;

a first fold line extending across the base, the side panels, and the top panel, said first fold line oriented such that folding the base and the side panels at the first fold line to move the end panels toward one another reduces tension on the hammock;

second fold lines between the base and the side panels;

said side panels restraining the base against folding at the first fold line when the side panels are folded along the second fold lines to an operational position alongside the hammock, thereby tensioning the hammock.

18. The invention of claim 17 wherein each brace is secured to the respective end panel, and wherein each brace is removably secured to the base by a respective tab formed on one of the brace and the base.

* * * * *